US006612779B1

(12) United States Patent
Scuero

(10) Patent No.: US 6,612,779 B1
(45) Date of Patent: Sep. 2, 2003

(54) EMBANKMENT DAM AND WATERPROOFING METHOD

(75) Inventor: Alberto Scuero, Castel San Pietro (CH)

(73) Assignee: Capri Tech Italia S.r.l., Arona (IT)

( * ) Notice: Subject to any disclaimer, the term of this patent is extended or adjusted under 35 U.S.C. 154(b) by 0 days.

(21) Appl. No.: 09/857,785

(22) PCT Filed: Dec. 6, 1999

(86) PCT No.: PCT/EP99/09534

§ 371 (c)(1),
(2), (4) Date: Aug. 22, 2001

(87) PCT Pub. No.: WO00/34587

PCT Pub. Date: Jun. 15, 2000

(30) Foreign Application Priority Data

Dec. 10, 1998 (IT) ..... MI98A2658

(51) Int. Cl.[7] ..... E02B 7/06; E02B 3/10; E02D 17/20

(52) U.S. Cl. ..... 405/116; 405/107; 405/117; 405/270; 405/302.7

(58) Field of Search ..... 405/52, 107, 109, 405/116, 117, 266, 267, 270, 302.7

(56) References Cited

U.S. PATENT DOCUMENTS

| | | | | | |
|---|---|---|---|---|---|
| 1,602,623 | A | * | 10/1926 | Noetzli | 405/109 |
| 1,802,714 | A | * | 4/1931 | Henry | 405/107 |
| 1,997,132 | A | * | 4/1935 | Collorio | 405/109 |
| 2,750,748 | A | * | 6/1956 | Kretzschmar | 405/107 |
| 2,949,743 | A | * | 8/1960 | Scheidenhelm | 405/107 |
| 3,811,286 | A | | 5/1974 | Feiner | |
| 4,090,363 | A | * | 5/1978 | List et al. | 405/109 |
| 4,266,885 | A | | 5/1981 | Naito et al. | |
| 5,454,668 | A | | 10/1995 | Liao | |

FOREIGN PATENT DOCUMENTS

| | | | | |
|---|---|---|---|---|
| DE | 3519526 | * | 11/1985 | 405/107 |
| DE | 38 08 269 A1 | | 9/1989 | |
| DE | 44 02 862 A1 | | 6/1994 | |
| EP | 0060578 | * | 9/1982 | 405/117 |
| JP | 58091212 | * | 5/1983 | 405/107 |

* cited by examiner

*Primary Examiner*—Jong-Suk (James) Lee
(74) *Attorney, Agent, or Firm*—Young & Thompson

(57) ABSTRACT

A dam includes a body (11) made of loose material, for example earth and/or rocks (A), and a water barrier (12) axially extending to the dam body (11), including a waterproofing layered membrane (13) and a zone of waterpermeable loose material (B), on at least one side of the membrane (13), which can be injected with a sealing fluid and is designed to avoid puncturing of the membrane (13) and to allow the monitoring of the leakage water due to failures in the waterproofing membrane (13). The water barrier (12) can be provided inside the dam body or close to the upstream face.

45 Claims, 9 Drawing Sheets

EMBANKMENT DAM AND WATERPROOFING METHOD

SCOPE OF INVENTION

This invention refers to embankment dams, and to an improved method for their construction and waterproofing.

STATE OF THE ART

Water resources become more and more precious and their conservation is becoming more and more important; therefore it is essential to search for and adopt solutions which minimise the waste of water and which allow a clever management of the existing water resources.

The most ancient typology of a dam is the embankment dam, obtained by using natural materials available on site for the creation of embankments capable of contrasting the pressure exerted by the water collected in the natural reservoir delimited by the dam itself. The dam body must be statically stable and at the same time it must avoid water leakage caused by possible infiltration, which would cause a decrease of the quantity of water resource available, and which could also jeopardise the stability or the safety factor of the dam itself. As a matter of fact, uncontrolled water infiltration into the dam body can cause undesirable interstitial pressures, erosion phenomena and the formation of preferential flows or of "piping" capable of causing even the collapse of the whole structure.

In many cases earthfill and/or rockfill dams are preferred to conventional concrete dams, to roller compacted concrete (RCC) dams, to masonry dams or other, as they are less expensive; therefore it is important to build embankment dams which have a high safety factor and are watertight.

During the years different techniques have been developed to make embankment dams watertight. There are substantially two tendencies for the waterproofing of embankment dams: the first one consists in waterproofing the upstream face, and the second one consists in creating a waterproofing core inside the body of the dam itself.

The waterproofing of the upstream face stops possible infiltration onto the dam surface next to the water impounded in the reservoir. The waterproofing barrier is executed on the slopes of the dam body and is therefore subject to stresses and deformations which occur over time in the dam body. This kind of barrier must therefore have good characteristics of elasticity and at the same time or watertightness.

In general this kind of barrier consists of an upstream face built in concrete, with waterproofing joints, waterstops In synthetic material and/or copper, or with facings made of a bituminous concrete.

In both cases the deformations which the dam body undergoes during exploitation are such as to cause possible failures in these waterproofing barriers with subsequent water loss and risk for the stability of the structure.

Recently, watertight upstream facings have been executed with flexible synthetic geomembranes, capable of granting the watertightness of the dam and at the same time capable of sustaining strong deformations, even concentrated, without damage.

Geomembranes simply laid over the upstream face of the dam, however, need ballasting layers in order to avoid that the geomembrane itself can be displaced or damaged by the suction exerted by winds, or by the fatigue caused by the action of waves.

A second solution which has been widely adopted in construction of embankment dam foresees the construction of a central watertight care, made with natural materials positioned so as to grant low permeability, lower than $1\times10^{-10}$ cm/sec, for example clay or bentonite, placed during construction of the embankment. In the latest decades, the central core has also been constructed in bituminous concrete and in conglomerates cement-bentonite based.

All the above-mentioned solutions have emphasised some constructive difficulties, as well as a rather high probability not to be able to reach the required reliability, besides the impossibility of checking the extent of their efficiency by measuring the occurring seepage. Furthermore, should infiltration or water leakage through the central core occur, the repair is extremely difficult and brings uncertain results.

An embankment dam of the type mentioned above is described in DE-A-4.402.862; this document suggests also the use of a water lightening core in bituminous concrete, and a sealing membrane to provide a small cavity upstream the central core and a filtering material, to allow said cavity to be filled with water upon construction of the dam, to subject the same dam to the maximum hydrostatic condition in absence of water into the basin Type and nature of the membrane is not described or suggested in this document, because the waterproofing of the dam is performed by the bituminous concrete core. Furthermore DE-A-4.402.862 does not suggest or make obvious to gradually construct the membrane and a transition zone of loose material, during construction of the dam, as well the use of a fine loose material suitable to inject a sealing substance upon failure of the membrane.

Hence, for the construction of embankment dams, the need of finding new construction and waterproofing solutions which, by using artificial materials, allow to obtain an effective watertightness for the whole life of the dam, by using systems and materials which can be coupled with aggregates of the dam body capable of granting only the static function, and which are also easily and economically constructed, whose efficiency can be checked over time and which, in case of damage, can be simply and efficiently repaired.

OBJECTS OF THE INVENTION

The main object of this invention is to execute an embankment dam and a construction and waterproofing method, which can reach the above-mentioned objectives, allowing to make consistent savings on the total cost of construction of the dam.

In particular, an object of this invention is to supply a method for the construction and the waterproofing of an embankment dam which uses a watertight barrier capable of adapting to any deformation of the dam body without loosing its efficiency or its watertightness.

A further object of this invention is to supply an embankment dam and construction and waterproofing method which allow to adopt suitable monitoring systems of the watertightness of the waterproofing barrier, and which at the same time allow to intervene for the necessary repairs, or to execute waterproofing connections with other rigid structures of the dam itself.

Another object of this invention is to supply a method for the construction and the waterproofing of an embankment dam which allows to use an upstream waterproofing system comprising a proper flexible synthetic geomembrane extending from the crest to the upstream toe of the dam, allowing a non-rigid connection of the geomembrane itself, capable of following the deformations, sometimes high, of the dam body itself which can occur over time.

A further object of this invention is to supply a method for the construction and the waterproofing of an embankment dam which allows to immediately use the dam, even if not yet finished, during its construction.

BRIEF DESCRIPTION OF THE INVENTION

According to this invention, a method has been provided for the waterproofing of a dam comprising an embankment body in coarse loose material having a longitudinal axis, in which the aforementioned dam body is made by superimposing layers of earth and/or rocks, and a water proofing barrier comprising a waterproofing membrane and a transition zone of fine loose material which develop from the bottom towards the top and which extend along the longitudinal axis of the dam, characterised by performing the waterproofing barrier including at least one synthetic and elastically yeildable waterproofing geomembrane and disposing at least on transition zone of selected loose material on at least the downstream side of the geomembrane, said loose material having a high water permeability for the injection, of fluid or fluidised sealing materials, gradually performing the transition zone and the waterproofing membrane during the construction of the body of the dam body; and providing anchoring means for progressively anchoring the waterproofing geomembrane to the transition zone during the construction of the dam.

According to a first particular aspect of the invention a method has been provided for the construction and the waterproofing of darns for retaining water in a reservoir, in which the dam comprises a body in coarse loose material, made by superimposed layers in earth and/or rock or similar, to provide a static function to resist to the thrust impounded by the water in the reservoir, the method comprising the steps of performing a central core defining a water-barrier in selected fine loose material, from sand to gravel, with a high permeability, higher than the dam body, for instance comprised between $1\times10^{-1}$ and $1\times10^{-5}$ cm/sec; this barrier incorporates at least a waterproofing membrane in an elastically yieldable synthetic material, extending from the dam body foundation to the crest, and longitudinally to the dam itself. At least one side of the waterproofing membrane is covered by at least one layer of synthetic material, for example a geotextile, capable of protecting the membrane against the mechanical aggression of the inert loose materials of the central core; the waterproofing membrane and the protecting layer in synthetic material being progressively incorporated in the different superimposed layers in loose material, during the construction of the dam body and of the central core.

According to another aspect of the invention, a method has been provided for the construction and the waterproofing of dams designed for retaining water in a reservoir, in which the dam comprises a body in coarse loose material, made of superimposed and compacted layers in earth and/or rock or similar, and a waterproofing membrane in an elastically yieldable synthetic material, extending from the dam body foundation to the crest, and longitudinally on an upstream face of the dam, the waterproofing membrane being fastened by means of strips of said elastically yieldable synthetic material, previously embedded between superimposed layers of loose material of said body of the dam, and successively welded to the waterproofing membrane during the construction and the installation on the above-mentioned upstream face.

According to a particular aspect of the invention, the waterproofing membrane is built on the upstream face of the dam already completed, by adjoining several sheets in synthetic material which are unrolled from the top to the bottom of the dam and welded to the anchoring strips embedded in the dam body during its construction.

According to another particular aspect of the invention, the waterproofing membrane is built on the upstream face of the dam by adjoining several sheets in synthetic material which are laid horizontally in respect to the longitudinal axis of the dam and welded to anchoring strips in synthetic material embedded in the dam body during the construction of the dam itself. This solution is particularly advantageous if compared to the previous ones because it allows an anticipate, although partial use of the dam, during its construction, without having to wait for the long time normally required for the stabilsation and testing of the dam after completion.

In the solution with the waterproofing membrane laid directly on the upstream face of the dam, the use of a waterproofing synthetic material, flexible and elastically extensible, coupled and adherent to a substrate in if synthetic material, such as a geotextile or similar, besides supplying a mechanical protection against any accidental puncturing of the waterproofing membrane by the loose material of the dam, supplies also surface with a high friction coefficient. This surface with high friction coefficient allows to maintain in their position the single sheets of the membrane during their installation, even if they are not yet welded to the anchoring strips.

The connection between the anchoring strips and the waterproofing membrane can be executed by thermo-welding in accordance with specific methods further explained, by using in any case for the waterproofing membrane and for the anchoring strips, synthetic materials that are chemically compatible for their heat-welding.

According to one more aspect of the invention, the lower edge of the waterproofing membrane is fastened to the dam body's upstream toe by creating a longitudinal bend which allows the membrane itself to better adapt to possible movements of the dam body.

For the scope of this invention the various words used have the meaning herein defined:

- geomembrane: flexible synthetic material with two prevailing dimensions, characterised by a low permeability to fluids;
- geocomposite: flexible synthetic material with two prevailing dimensions, made by coupling, during production, of two or more layers of synthetic materials with different characteristics and functions, one of which consists of a geomembrane having a waterproofing function;
- geosynthetic: synthetic material with two prevailing dimensions; which depending on its characteristic can have different functions such as waterproofing, anti-puncturing protection, sliding, etc.;
- geotextile: synthetic material consisting of textile fibres, with high permeability;
- layered membrane: consists of at least two layers of synthetic materials with two prevailing dimensions, having different functions, which can be coupled during manufacturing or can be only superimposed during the construction of the dam.

BRIEF DESCRIPTION OF THE DRAWINGS

These and further characteristics and advantages of the method for construction of embankment dams, as well as of the waterproofing system, will better result from the following description of some examples of preferential embodiments.

In the drawings.

FIGS. from 11 to 14 show some significant constructional phases of an embankment dam with a central core having a double layered membrane according to an alternative embodiment of the invention.

Figure 15:
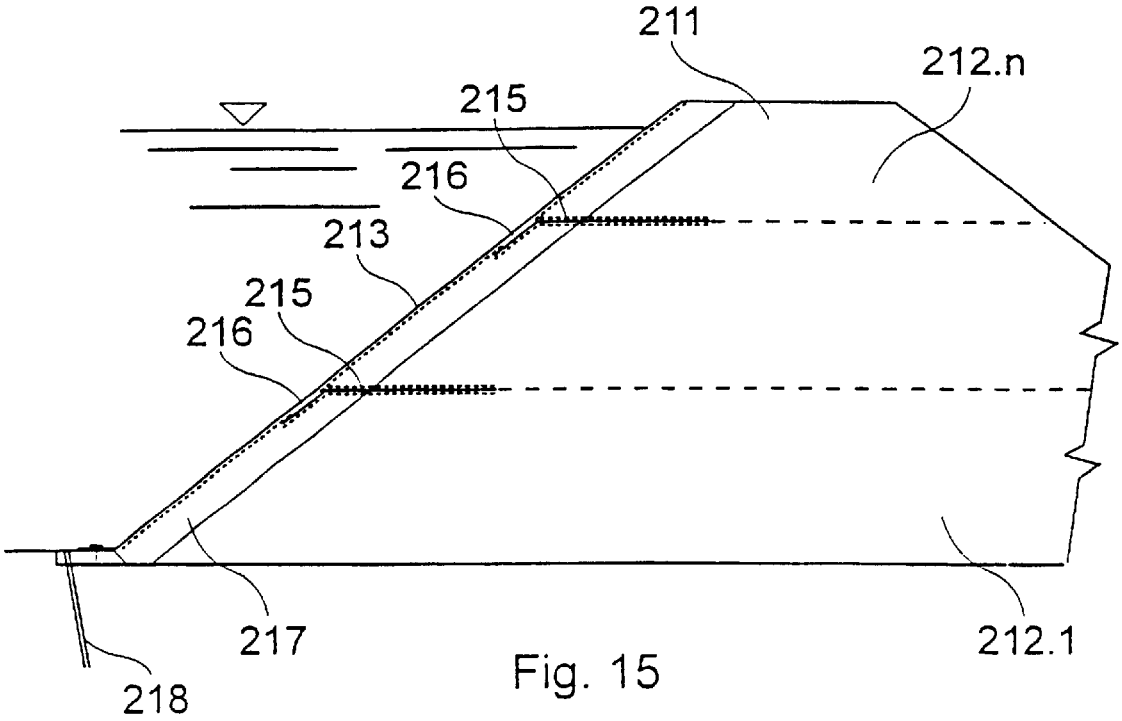
Figure 16:
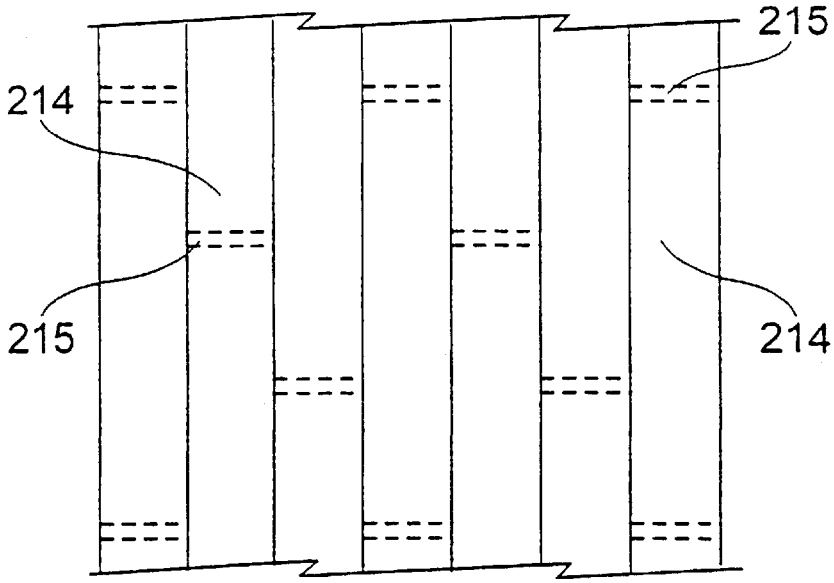
Figure 17:
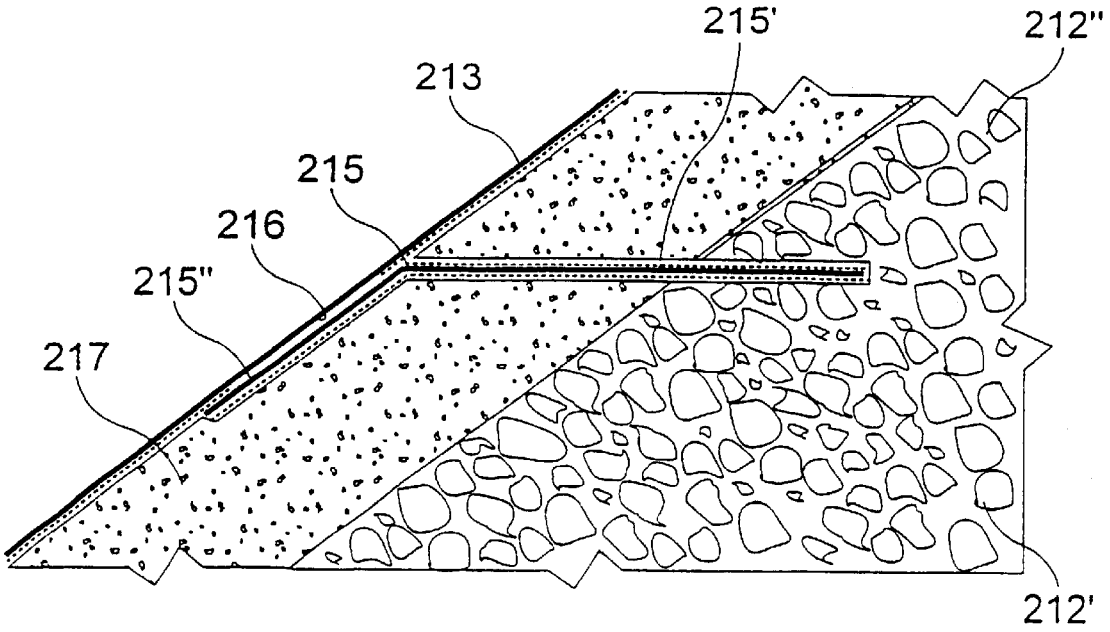
Figure 18:
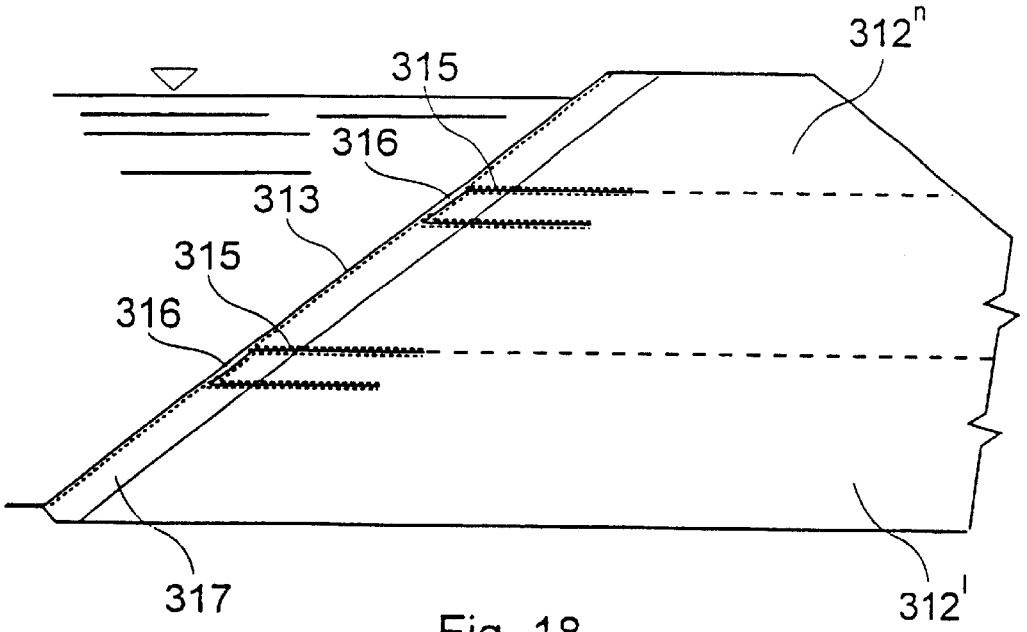
Figure 19:
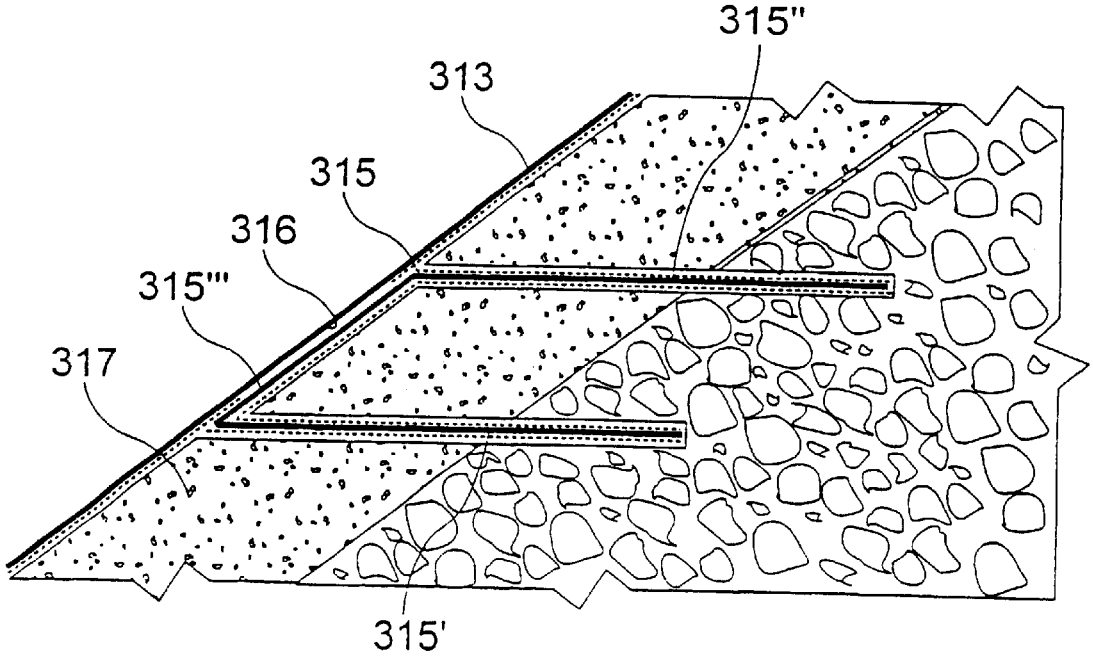
Figure 20:
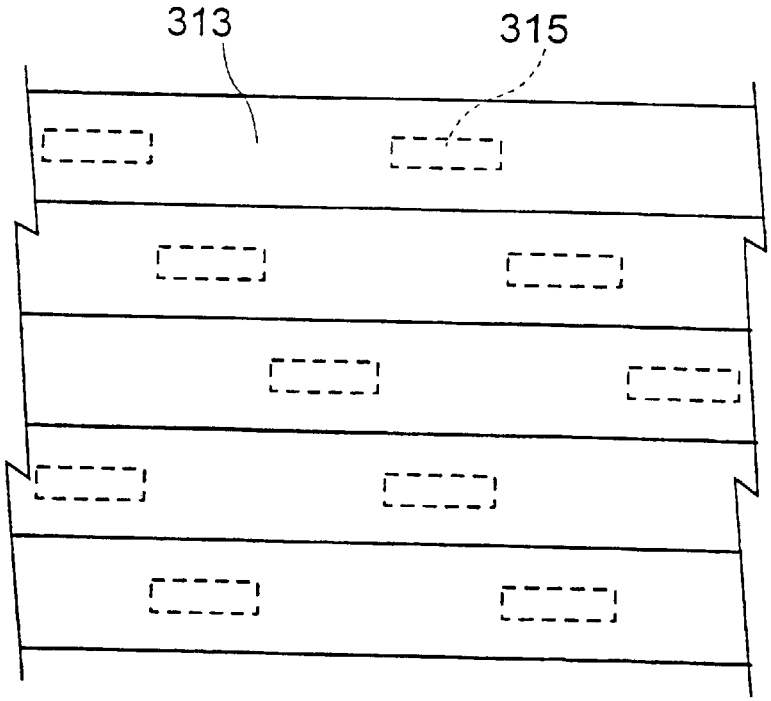
Figure 21:
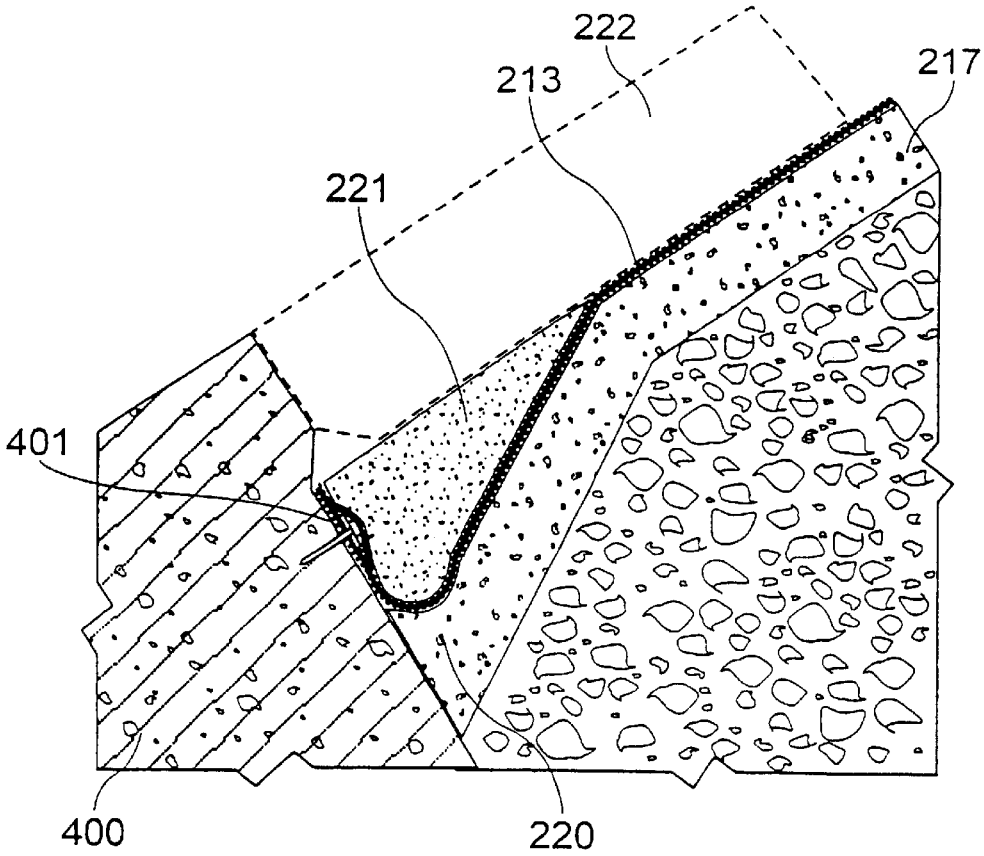
Figure 22:
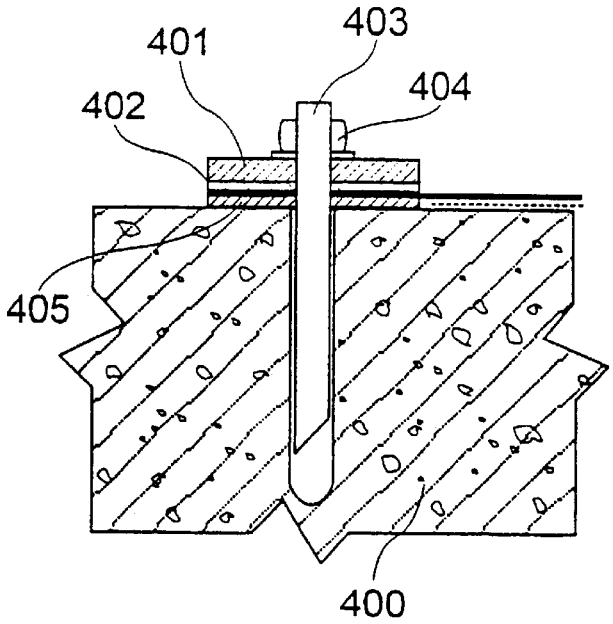

FIG. 15 shows a first way of constructing a waterproofing barrier according to the invention in correspondence of the upstream face;

FIG. 16 shows part of a front view of the waterproofing layered membrane on the upstream face of the dam of FIG. 15;

FIG. 17 shows an enlarged detail of FIG. 15;

FIG. 18 shows a second way of constructing a waterproofing barrier next to the upstream face;

FIG. 19 shows an enlarged details of FIG. 18;

FIG. 20 shows part of a front view of the waterproofing layered membrane on the upstream face of the dam of the previous figures;

FIG. 21 shows an enlarged detail of an anchoring system at the lower edge of the waterproofing layered membrane;

FIG. 22 is an enlarged detail of FIG. 21.

DETAILED DESCRIPTION OF THE INVENTION

Central Waterproofing Layered Membrane

With reference to FIGS. from 1 to 5 we will describe at first the conceptual scheme and the general construction principles of an embankment dam with a central waterproofing layered membrane, according to the invention.

Figure 1:
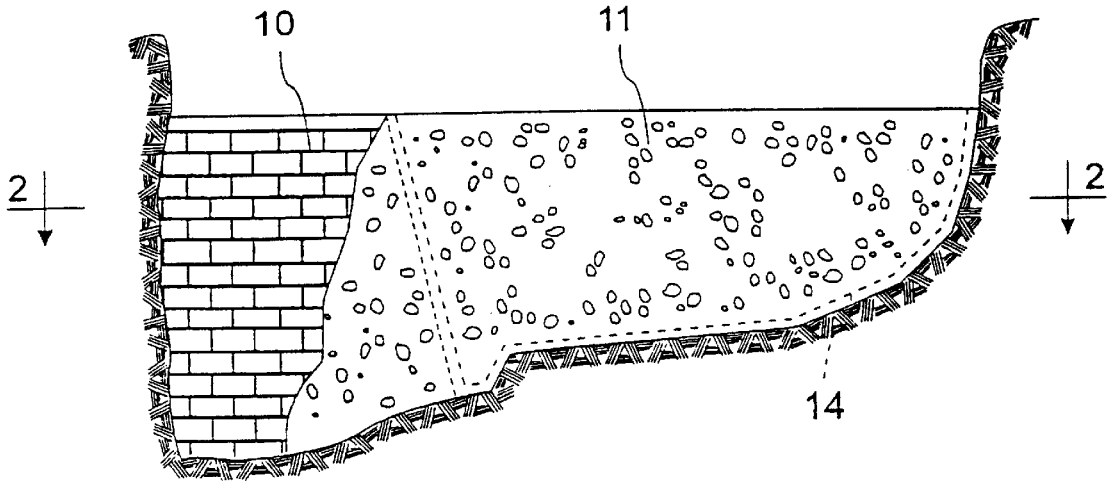
FIG. 1 is a front view of a generic dam, part of which has been realised in loose material according to a first type of realisation of an embankment dam having a central waterproofing core according to this invention.
Figure 2:
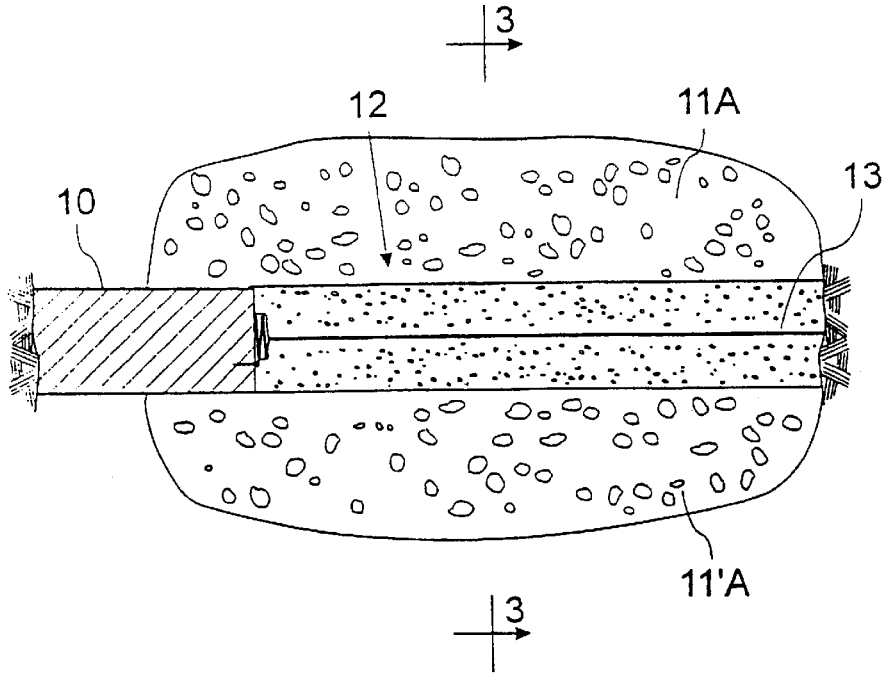
FIG. 2 is a section according to line 2—2 of FIG. 1.

FIG. 1 show an example of a generic dam which includes a part 10 for instance in concrete, consisting instance in a spillway, an intake tower or other, and a part 11 in coarse loose material, comprises an upstream dam body 11A and a downstream dam body 11'A in earth and/or rock, and a water-barrier including a central core 12 in fine loose material suitably selected to constitute a proper transition layer, having characteristics of permeability and injectability which will be further explained; the core 12 in the example under consideration has been made waterproof by means of a layered membrane 13 consisting of a "package" of geosynthetics, which extends in the direction of the longitudinal axis of the dam, starting from a concrete beam 16 for the anchorage to the foundation of the dam body 11, towards the top, up to the crest, the layered membrane thus being incorporated in the mass of loose material which forms the central core 12.

Figure 4:
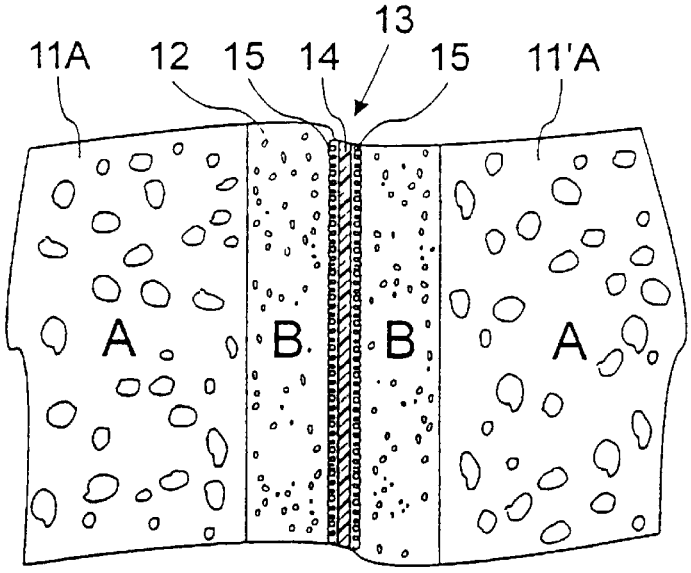
FIG. 4 is an enlarged detail of FIG. 3.

In particular, as shown in the detail of FIG. 4, the waterproofing package 13 is substantially composed of a geomembrane 14 in synthetic, waterproofing, flexible and elastically yieldable material, for example in PVC or PE or PP of adequate thickness, and of two lateral protective substrates 15, one on each side, in synthetic material, for example a geotextile, in order to avoid any accidental puncturing of the waterproofing geomembrane and hence a loss of watertightness of the membrane 13 itself.

As shown in the above-mentioned figures, according to this first embodiment of the invention, a central core of the waterproofing barrier is constructed, placed vertically or inclined, in fine or granular loose material B, adequately selected, preferably monogranular, incorporating a waterproofing package 13 in synthetic material. This material has adequate flexibility and elasticity characteristics, to follow and/or compensate movements of the dam body 11A, 11'A which may occur over time, without failure; package 13 at the dam upstream toe is fastened to a concrete beam 16 or otherwise connected to the foundation.

Figure 3:
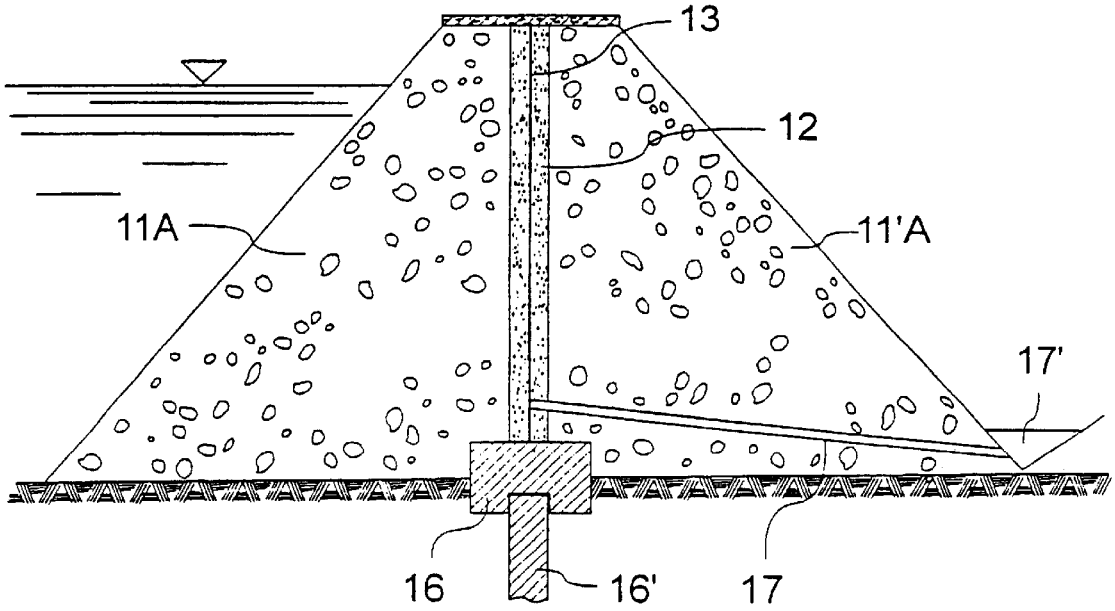
FIG. 3 is a section according to line 3—3 of FIG. 2.

Therefore, as shown in the sectional view of FIG. 3, the waterproofing package 13 is disposed inside or between two side by side arranged and vertically extending zones constituting the central core 12; these two zones are covered with the different layers A of coarse loose material composing the dam body, placed both on the upstream side and the downstream side of the artificial waterproofing barrier thus constructed.

According to the scheme of the above-mentioned figures, package 13 has the primary function of waterproofing and watertightness, while the loose material B of core 12 has a transition and, if necessary, a drainage function. On the contrary, the natural or inert material A constituting the body 11A and 11'A of the dam, has the sole static function of resisting to the thrust impounded by the water in the upstream reservoir.

During construction as well as during operation of the dam, the central waterproofing layer 14 of package 13 is therefore protected on both sides, the upstream side and the downstream side, by one or more substrates 15 of flexible synthetic material, such as geotextile or similar. The aim is to favour the distribution of the hydrostatic pressures which act on the dam body itself and which are transmitted to core 12 as well, as well as to reduce the effect of the mechanical aggression, by puncturing and/or abrasion, exerted by inert materials on the geomembrane of the water barrier, as previously discussed.

Layer 15 of protection synthetic material can be independent from internal layer 14 (geomembrane) or can be hot-coupled to it like a sandwich. The waterproofing layered membrane consisting of layer 14 and of protecting geotextiles 15 is therefore in contact with a layer of adequately selected fine loose material, for instance granular material, such as sand, stony material such as gravel or similar, with dimensions ranging between 3 mm and 30 mm approximately. The dimensions of the loose material can be greater and even reach 10 cm, according to the requirements for transition and drainage of the central core; even if it is not necessary, it is generally preferred that material B of the transition area of core 12 is a monogranular material or, e.g., it may be requested that the selected material which forms the downstream zone of the central core has a high degree of permeability to fluids, comprised approx. between about $1\times10^{-1}$ and $1\times10^{-5}$ cm/sec in order to allow, if needed, efficient drainage of the water which could seep through cracks or local failure of geomembrane 14.

Therefore the combination of the selected material B of core 12, of geotextiles 15 and geomembrane 14 allows to create an effective waterproofing and at the same time an optimal transfer of the static loads from body 11A to body 11'A of the dam, through core 12, while at the same time constructing an effective coupling of the various separation interfaces between material A which forms body 11A, 11'A of the dam, generally consisting of earth and/or rock, and the selected stony material B constituting central core 12.

As previously mentioned, at the dam bottom along the entire foundation line, package 13 is watertightly and intimately connected to a concrete beam 16, or a similar anchoring mean, from which a waterproofing screen 16' departs towards the underlying soil; this waterproofing screen is executed for example by means of grouting with concrete or resins or similar and more generally by plastic diaphragms.

The perimeter beam 16 can be independent or be part of an inspection gallery (not shown) placed at the dam base, in axis with central care 12.

The fundamental reason for the presence of the foundation beam or of other equivalent structure is to have an anchoring element for the geomembrane, and a connection between the waterproofing barriers over and under the foundation plan.

Behind package 13, on the downstream side, starting from layer B in fine selected material of central core 12, at the bottom of central core 12, in correspondence of beam 16, it is possible to create a drainage pipe system. The system consists of pipes 17 which are inclined towards the dam's downstream side and are able to collect any water infiltration through cracks or failure of package 13 which can consequently be monitored.

The drained waters can be conveyed to one or more collecting points 17' where they are monitored by means of proper devices and successively discharged downstream.

The above-mentioned system provides the following advantages:

1) It creates a continuous artificial waterproofing barrier, in flexible synthetic material, which extends from the foundation to the crest of the dam body. The waterproofing barrier can continue to reach the deep layers of the ground by means of screen 16', executed by grouting or with suitable plastic diaphragms, which departs from the foundation beam 16 which thus constitutes the connecting element;
2) It constructs a watertight core, able to follow the dam body's deformations which occur over time due to the settlement which the dam body itself undergoes due to its own weight and to the hydrostatic load, keeping the waterproofing and deformability characteristics of the waterproofing core unaltered over time;
3) it verifies the efficiency of the waterproofing system by means of the monitoring system placed downstream of the central core itself.

Connection with Rigid Structures

In some situations, as schematically represented in FIG. 1, it may occur that body 11A, 11'A of the embankment dam, with waterproofing core 12 and package 13, are in contact with rigid parts of the dam itself, for example executed in conventional concrete, in roller compacted concrete (RCC), in masonry or other.

This situation occurs when only a part of the dam is built in loose material, while the other part is a gravity dam executed with conventional techniques. The same situation occurs also when an intake tower, executed in concrete or masonry, is inserted in the body of the embankment dam.

In these cases, it is necessary to achieve the continuity of the waterproofing between package 13 of the central core of the embankment dam, subject to greater deformations, and the part of structure 10, more rigid, subject to smaller deformations.

Figure 5:
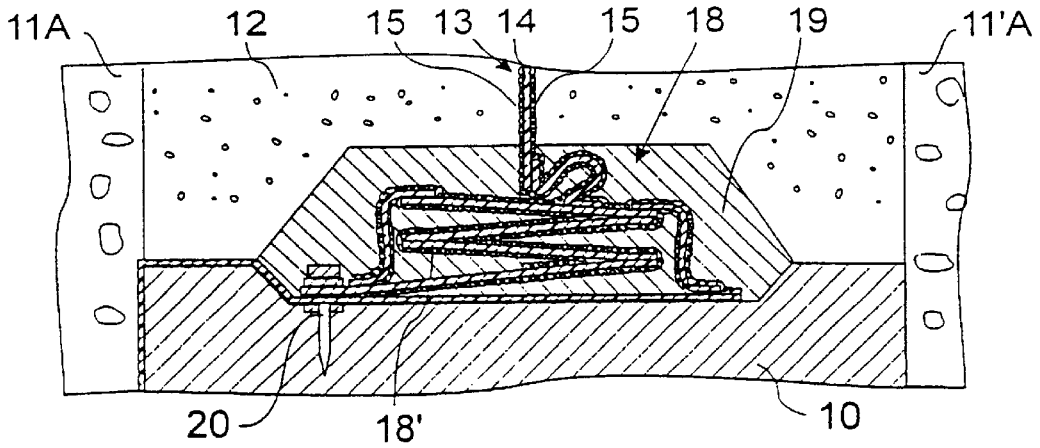
FIG. 5 is an enlarged detail of FIG. 2.

For this purpose, as schematically shown in FIG. 5, the connection of the waterproofing package 13 to the rigid body 10 of the dam can be made by means of one or more strips 18 consisting of bands 18' of supplementary layered membranes, of the same material as package 13, installed vertically like in a bellows-shape, adherent to the rigid body 10 as shown. A vertical edge of the bellows-shaped package 18 is watertight anchored to the rigid body of the dam by means of mechanical fastening devices, schematically shown, e.g. by means of metal profiles which fasten by compression the edge of strip 18 folded in a bellows-shape against the rigid body 10, to which the profiles are fastened by means of bolts and washers 20, while the other vertical edge of strip 18 is heat-welded to the correspondent opposite edge of package 13. Strip 18 will thus form a kind of bellows-shaped folds, like in a bellows. The folds are executed by welding geomembrane bands 18' according to the "joined-hands" scheme, or by folding a membrane strip on itself. This bellows-shaped folded element which faces the dam body 11A, 11'A in loose material, is left free to move or to follow the deformations which the dam can be subjected to over time.

The connection between package 13 of the central core and the strip layered, bellows-shaped membrane 18, can be executed directly or by means of supplementary elastic strips suitably shaped with extra material, and made of the same material as package 13.

The bellows can be protected on its sides by further elastic strips. Strips 18' of the bellows, made of the same material as package 13, are properly shaped or welded in the "joined-hands" configuration, with extra material, so that they can form further supplementary deformable bellows.

Between the bellows' strips made of layered membrane, and above them, other layers of material 19 can be placed, which reduce the friction and therefore facilitate the relative sliding (geotextile, synthetic liners, layers of silicon, of Teflon, sand, etc.), and which supply a further protection to the bellows.

The settlement of dam body 11A, 11'A in loose material will therefore produce stresses in the contact surface between body 11A, 11'A and the rigid body 10; in this zone the bellows-shaped layered membrane is installed, which, due to its geometric shape and to the elastic characteristics of the material with which it has been made, will allow to follow this settlement.

Practically body 11A, 11'A in loose material settles, causing a correspondent lowering of the elevations of the different layers of the package of the layered membrane 13 contained in the central core 12. Since package 13 is connected to the external edge of the strip of the bellows-shaped layered membrane 18, also this one will be compelled to go down according to the settlement of body 11A, 11'A of the dam. The internal edge of the bellows-shaped membrane 18 is on the contrary rigidly connected to the rigid part 10 of the dam, as previously described. Therefore, the variation in position between the internal edge which remains fixed, and the external edge which goes down, will be absorbed partly by the folds of bellows 18, partly by the supplementary connection strips, if present, as well as by the minimum rotation of the bands of the bellows itself and by the elasticity of the material which package 13 is made of.

The described solution is such that, while the fill constituting body 11A and 11'A of the embankment dam settles, package 13 can freely follow such settlements while keeping the waterproofing connection with the rigid structure 10.

In certain situations it would even be possible to avoid the use of the bellows-shaped membrane 18, as the settlement of body 11A, 11'A in loose material normally occurs in an almost homogeneous and linear way; therefore, the supplementary elastic strips alone could provide a high safety coefficient by coping with the induced deformation and the resulting stress, since package 13 and the bellows strips 18, which are able to undergo elongation at break which can reach 200% and more, contribute to absorb the deformations and the stresses.

Central Double Waterproofing Membrane

Figure 6:
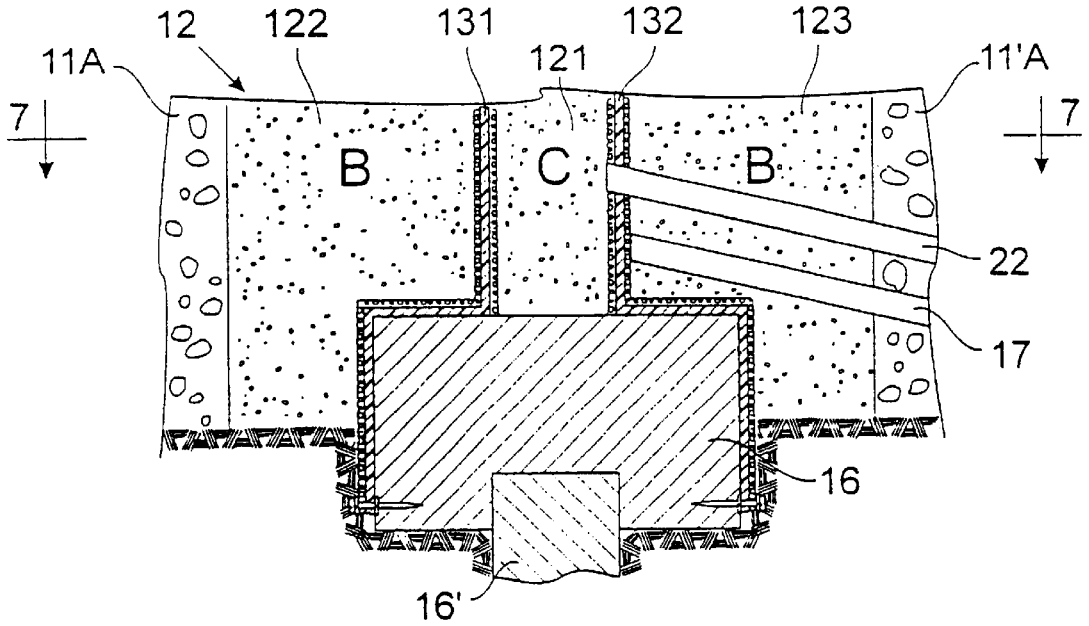
FIG. 6 is an enlarged detail of a second type of an embankment dam having a central waterproofing core.
Figure 7:
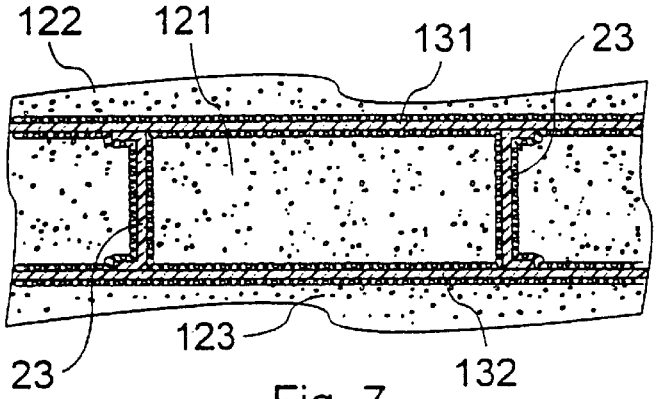
FIG. 7 is a cross-sectional view according to line 7—7 of FIG. 6.

FIGS. 1–5 show the use of a single package 13 as a waterproofing element of the central core 12; other solutions are nevertheless possible, one of which is shown in FIGS. 6 and 7 of the attached drawings.

As shown in these figures, in order to increase the safety and waterproofing degree of the central core 12, it is possible to install two adjoining packages 131 and 132 in impermeable synthetic and elastically yieldable material, perfectly identical to package 13. The two packages are at a suitable distance one from the other, and are positioned parallel to the longitudinal axis of the dam, from the base of the body in loose material 11A, 11'A, to the crest of the dam.

In this case, the central core 12 in selected loose material includes an intermediate zone 121 placed in the gap between the two packages 131 and 132, and two lateral confinement zones 122, 123.

The intermediate zone 121 thus created must have a grading suitable to allow the injection, if necessary, of fluid or fluidised substances for the sealing of leakage, such as bentonite sludge or other, capable of locally creating or restoring watertightness in case of puncturing or failure of package 131.

Also in this case, both packages 131 and 132 are placed inside a fine or granular material selected, from sand to gravely, as previously shown, and are protected on both faces by a Layer of flexible synthetic material 15, of geotextile type, with an anti-puncturing and anti-grip function.

The selected material of the zone 121 between the two packages 131, 132 must allow an adequate transfer of the loads from one side of the dam body to the other one and must always have a high degree of injectability for the foreseen scopes, creating a homogeneous static body.

Also in this case the two packages 131 and 132 are fastened to the dam perimeter, on the foundation, with a watertight mechanical anchorage. Again, from the concrete perimeter beam 16 or similar can depart a waterproofing screen 16' executed by grouting or by plastic diaphragms, as previously mentioned.

In general, the fine selected material of zone 121 placed between the two membranes, and if necessary the fine selected material of the two lateral zones 122 and 123, can be of the same type B previously described for the central core 12 of the example or FIG. 1, namely it must have a high decree or injectability and draining capacity; yet, according to the requirements, it is possible to use selected materials B and C with different draining characteristics for the three zones 121, 122 and 123 of the central core, as shown in FIG. 6.

The example of FIG. 7 shows another variant which is possible if the configuration with the two packages 131 and 132 is adopted.

As shown in FIG. 7, the two packages, the upstream one 131 and the downstream one 132, can be connected one with the other, at prefixed distances, with transversal connections made 23 with other strips of the same package, in order to create separate blocks in the intermediate zone 121 of the central core. The blocks can be monitored and drained individually, thus allowing to detect with greater accuracy any leakage or inefficiency of the waterproofing system.

The above-mentioned double-package system allows the following advantages:

1) it creates a continuous artificial double waterproofing barrier, in flexible synthetic material, which again extends from the foundation up to the crest. The waterproofing barrier thus created can be extended to reach the deep layers of the ground by means of a screen obtained by grouting with suitable material, or by a plastic diaphragm, based on concrete-bentonite mixtures, starting from the foundation beam 16. Moreover, the upstream barrier consisting of the first waterproofing package 131 grants the required watertightness, while the second waterproofing package 132, downstream constitutes a safety barrier;
2) it creates a waterproofing barrier capable of following the deformations of the dam body which occur over time and due to the hydrostatic load, maintaining the waterproofing and deformability characteristics unaltered;
3) it allows to test the efficiency of the waterproofing system by means of the monitoring system placed downstream of both packages, by means of a pipe system 17 which collects any infiltration or leakage downstream of the second package 132, as well as by means of a second system of pipes 22 which open towards he gap delimited by the two packages 131 and 132, in order to collect the infiltration or the leakage coming from the upstream package 131, through the layer of draining material 121 of the central core;
4) in case of deficiencies of the upstream package 131 it is possible to execute waterproofing grouting of zone 121 with conventional techniques such as grouting with bentonite or other suitable material, either locally or, in the entire zone 121 of selected material placed in the gap between the two packages. Therefore the two packages 131 and 132 shall carry out, besides the waterproofing function, also a confinement function for the future grouting of waterproofing material, thus allowing to restore the watertightness of the water barrier. The whole system is very simple and efficient, since the high degree of injectability of the layer of material of the intermediate zone 121 allows to insert suitable grouting pipes, until the desired point is reached; however it is better to position the injection pipes at prefixed locations, during the construction phases of core 12. Moreover, the system of draining pipe 17 and/or 22 allows to verify the efficiency of the repair intervention carried out as described.

As an alternative to this embodiment, it is possible to extend package 13 of FIG. 3 or package 131 of FIG. 6 towards the upstream toe of the dam body in order to build the foundation beam 16 in correspondence of the upstream toe itself, at connection with the upstream face.

This alternative solution would allow in some cases to reduce the depth of screen 16' with evident economical advantages; furthermore, the solution gives the possibility of further intervening on the same screen, even after completion of the dam and after dewatering the reservoir, since beam 16 would be in an accessible position, instead of being confined under the central core. It is also possible to further extend package 13 or 131 upstream, inside the reservoir created by the dam, by eliminating in this case the construction of the perimeter beam 16 on the upstream toe.

A further constructional alternative of the central core and of the waterproofing geomembranes is shown by the examples of FIGS. from 11 to 14. In particular, with reference to FIG. 14, in this case the two packages 131 and 132 are executed by a plurality of inclined strips having the tipical disposition, of a "Christmas tree", that is to say with the strips of each package placed inclined alternatively in opposite directions, suitably heat-welded along their longitudinal edges.

More precisely, both packages 131 and 132 have been executed by means of a plurality of heat-welded strips 25.1–25.n and 26.1–26.n, alternatively inclined upstream and downstream with the natural friction angle of the loose material used (normally between 15° and 40° in respect to a horizontal plan) according to the characteristics of the materials employed, and to the thickness of the layers of loose material A and B which constitute body 11A, 11'A of the dam and the various sections 121, 122 and 123 of selected ill, constituting the central core, or in function of other circumstances or necessities.

Also in this case the characteristics of the loose material used for the various layers of the various sections of the central core can be the same or different, depending on the specific requirements.

Various constructive techniques are possible depending or the type and characteristics of the geomembranes employed, that is to say if the geomembrane or the geomembranes result from joining of vertical strips, or from joining of inclined strips.

Constructive Methods

In general, the packages are installed following the constructional phases of the "embankment"; therefore the upper elevation of the central core 12 increases with the elevation of the body 11A, 11'A of the dam. Furthermore, the choice of the typology depends on whether it is necessary to connect with a rigid body 10, which is not always present.

In general, according to the examples of the various figures, the first operation to be performed is the execution of the foundation beam 16 which may or may not be a part of a possible perimeter inspection gallery. Then the packages are connected to the perimeter beam with mechanical fastenings or other type of anchorage which can grant watertightness in presence of hydraulic loads not inferior to the service ones.

In the various hypothesised cases the intermediate zone of the central core, comprised between the two packages will be put in contact with the monitoring and drainage discharge system. Then the construction of the dam body and the central core will begin, for example according to one of the two methods described here below.

Figure 8:
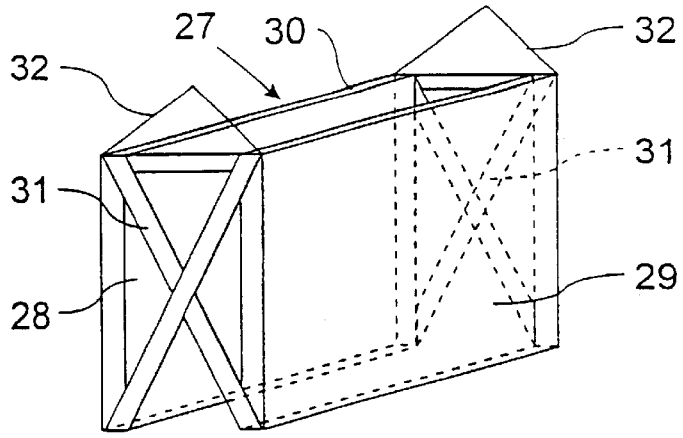
FIG. 8 is a schematic view of a scaffolding which can be used for the construction of an embankment dam according to the example of FIG. 6.
Figure 9:
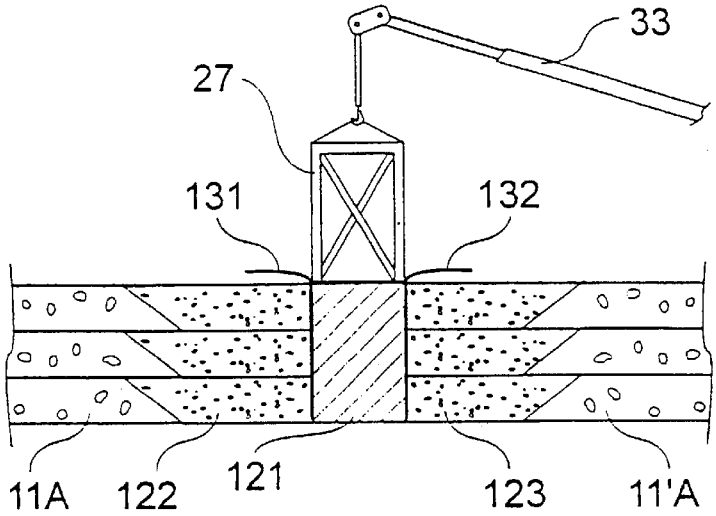
FIGS. 9 and 10 show some significant constructional phases of an embankment dam having a central core with a double waterproofing layered membrane, according to the example of FIG. 6.
Figure 10:
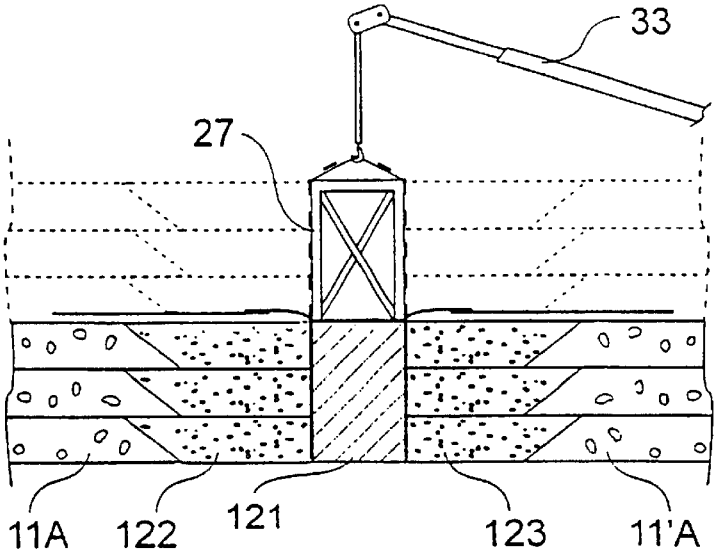

Construction by vertical sectors can be executed by means of extractable formworks, according to the example of FIGS. 6 and 8 and the phases shown in FIGS. 9 and 10 of the drawings attached.

In particular FIG. 8 shows a possible type of realisation of extractable formworks 27, substantially consisting of two lateral walls 28, 29 parallelly placed and kept apart by means of upper crosspieces 30 and criss-crossed bars 31. Number 32 indicates two hooking structures for hoisting formworks 27 by means of arm 33 of a crane, or by means of any other suitable hoisting device. The distance between the two lateral walls 28, 29 of the formworks substantially corresponds to the width of the intermediate area 121 of the central core, included between the two packages 131 and 132.

The fundamental construction phases which characterise this first method are illustrated in FIGS. 9 and 10 which represent intermediate moments in the construction of the central core and of the dam body.

According to this first constructional technique, the elements of formworks 27 are placed side by side, aligned with the longitudinal axis of the dam, till they cover the whole length of the section interested. In these conditions the geomembrane strips contained in packages 131 and 132 are placed on both sides of the formworks and laterally folded towards the outside. The geomembranes are then laid on formworks 27 with the interposition of a geotextile layer on both sides. The upper part of the two geomembrane strips with the geotextiles are fastened at tops with temporary anchors, for example with clamps or other. The geomembranes, supplied in rolls, are heat-joined one to the other in order to get a total length equivalent to the total length of the various elements of the formworks which are positioned along the longitudinal axis of the dam body to be executed. If needed, it is possible to create transverse compartmentation sectors 23 of the intermediate area of the central core, by transversally interposing between contiguous formworks, between the abutting faces, other geomembrane strips, protected by geotextiles, which are heat-coupled on the two edges to the upstream and downstream geomembrane strips positioned horizontally on the two sides of the central core.

The construction of the embankment can then start or continue. The first operation is the spreading and compacting by layers of the selected material of the central core 122 and 123, placed upstream and downstream of the formworks, and of the material of zone 121 placed inside the formworks in contact with the geotextile placed as a protection of the geomembrane on both faces.

Then the material with the biggest dimensions which constitutes body 11A, 11'A of the dam, upstream and downstream of the central core is laid and compacted. These operations continue until the dam body reaches an elevation close to the upper edge of the formworks which therefore result in the end embedded in the dam body.

The clamps which fasten the geomembranes and the geotextiles are removed, and the geomembranes with the geotextiles are folded again on the sides of formworks 27, as shown in FIG. 9. By means of a crane or other suitable hoisting device formworks 27 are removed for almost their whole height, if necessary, also by applying to it some vibrators which can favour the operation and contribute to compacting the material of the core. The formworks are then positioned for the execution of further layers of core 12 consisting of 121, 122 and 123, and of body 11A, 11'A of the dam. New geomembrane rolls are laid on the embankment, their edges overlapping on the ones of the geomembrane strips which have already been embedded in the central core under construction. The connection welds are executed, and their watertightness is tested. The new geomembrane strips are then uplifted and fastened again over formworks 27, as shown with dashed lines in FIG. 10, always previously interposing the geotextile layers. The installation and compaction of the selected material of the central core 12 and of the other inert materials of the dam body 11A, 11'A starts again according to the phases previously described, till the final elevation of the crest of the dam body is reached.

At last, a continuous concrete slab is built on the crest, and the upper edges o the two geomembrane 131 and 132, which have been thus executed and incorporated in the selected and injectable loose material of the central core, are mechanically fastened to it.

As an alternative to the above-described solution, which uses a plurality of formworks open along all the peripheral edges, the various horizontal strips of the geomembrane can be vertically fastened to a plurality of fixed or removable linear supports. The supports can consist of rigid pipes in plastic material, which can be used also for any future injections or be of other type. The construction of the central core and of the dam body occurs substantially according to the same method adopted with the extractable formworks. The vertical supports, if removable, can be used again as the elevation of the embankment increases, or can be left as permanent supports, embedded in the central core itself. If injection pipes are adopted as temporary support of the geomembranes, when construction is completed, and should injections be carried out inside the core to waterproof it, the pipes themselves could be used for this purpose.

The constructional technique with the "zigzagged" or "Christmas tree" geomembranes is shown in the following FIGS. from 11 to 14, which represent some of the fundamental phases of this constructional technique.

Figure 11:
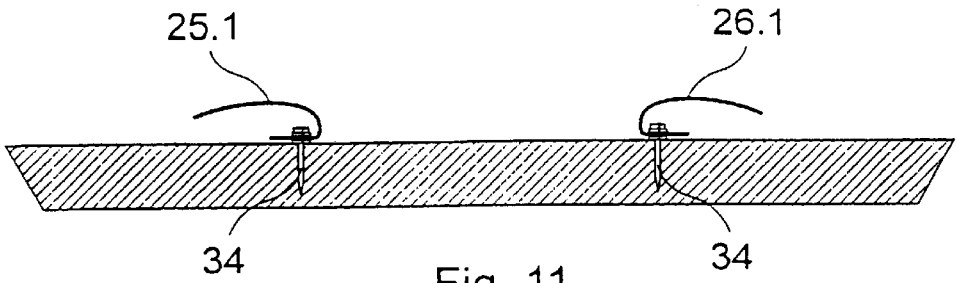

The first strips of the two packages 131 and 132 are preliminarly fastened to the foundation beam 16 by means of proper watertight anchoring devices 34. The geomembranes are again supplied in rolls, joined one to the other in order to obtain a length equivalent to the total length of the core at the relevant elevation of the foundation; the two first strips of the geomembranes are folded towards the outside as in FIG. 11.

Figure 12:
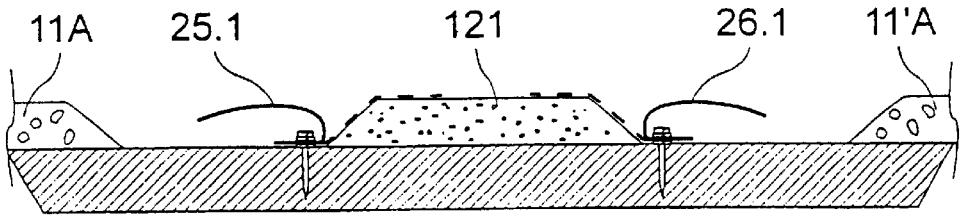

It is then possible to start the construction of the embankment; at first, a first layer of selected material constituting the intermediate zone 121 of the core, and the two upstream and downstream layers of body 11A, 11'A of the dam, are laid down and compacted. Then the two geomembrane strips are folded inside, along the inclined sides of the layer of material 121, as described in FIG. 12.

Figure 13:
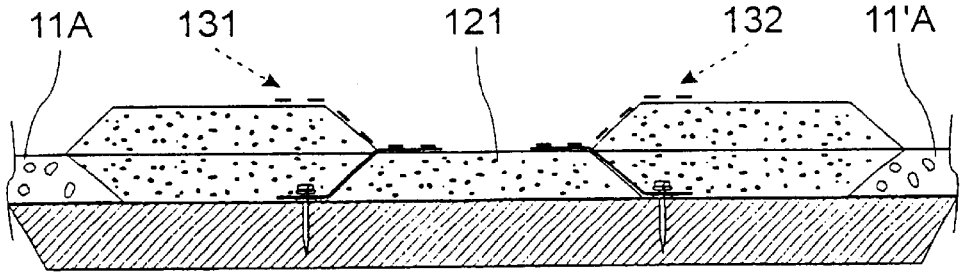

Subsequently, two overlapped layers of selected material are laid and compacted in the upstream zone 122 and in the downstream zone 123 of the central core, as it is schematically shown in FIG. 13.

Then the two following strips 131 and 132 are placed, with an inclination opposite to the previous ones, laying them on the lateral layers 122 and 123, which have been previously laid and compacted, and joining them with the underlying strips.

Figure 14:
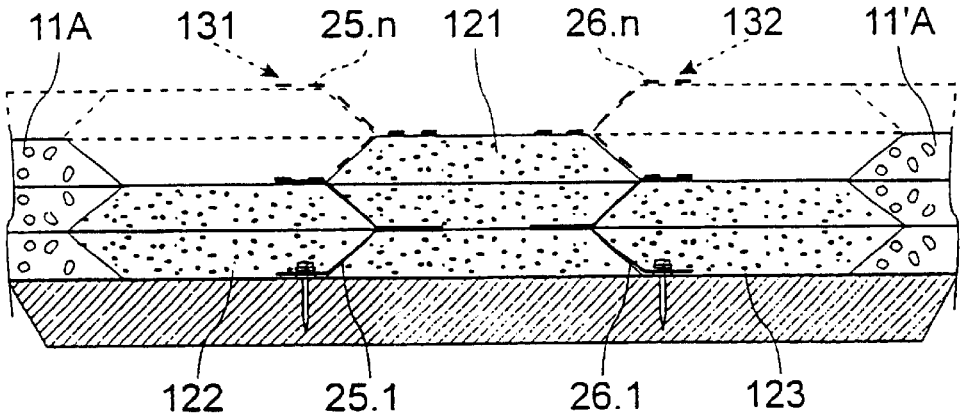

The construction of the embankment and of the central core with the two "zigzag" or "Christmas tree" packages continues in the same was in subsequent stages, as shown in FIG. 14, till the final height of the embankment and of the central core, required for the dam body to be executed, are reached.

During the construction of the central core and of the two "Christmas tree" packages, vertical compartmentation sectors can be created by interposing, transversally to the longitudinal axis of the core, other geomembrane strips heat-coupled to the two upstream and downstream longitudinal geomembranes under construction. Also in this case the various geomembrane strips are protected on both sides with geotextiles as in the previous case.

Again, at the end a final crest is built, consisting of a continuous slab made of concrete or bituminous concrete or another suitable material, to which the upper edges of the two packages are mechanically fastened.

As mentioned several times, the material used for the waterproofing of the core is a geomembrane in synthetic, flexible, elastically yielding material, with a high thickness, or example with a thickness comprised between 2 mm and 4 mm, capable of resisting the high puncturing and abrasion stresses which can arise in correspondence of the contact interfaces with the loose material of the central core. The geomembrane is also capable of resisting the deformations—even concentrated—which the dam body can undergo over time; therefore, the geomembrane must be made of a thermoplastic or elastomeric material able to allow even high elastic elongation. The junctions of the geomembrane strips can be executed with any suitable technique, for example by hot-air welding, keeping the possibility of carrying out tests of the efficiency of the welds themselves.

The geotextile adopted for the protection of the geomembranes shall have a sufficient mass to grant a high resistance to puncturing and good draining characteristics. Should the project specifications require it, both for the construction method with formworks and for the "Christmas tree" construction method, the geomembrane could be heat-coupled to the geotextile during extrusion in order to improve the characteristics of mechanical resistance of the waterproofing package thus constructed.

From what said and shown it is therefore clear that we have supplied an embankment dam with a waterproofing central core, and a method for constructing and waterproofing it by means of a single layered membrane or a double layered membrane, which do not require onerous operations and complex job-site equipment. The construction of the waterproofing central core occurs at the same time as the construction of the earth and/or rock embankment of the dam body.

The proposed solutions can be executed with synthetic materials having performances exceeding the results of the theoretic calculations; moreover, the production and the preparation of the waterproofing synthetic material occurs in the factory, under controlled conditions which grant constant quality.

The downstream zone of the central core, situated immediately downstream the geomembranes, consists of selected material of high permeability, through which it is possible to detect any water seepage, and which allows a continuous monitoring of the efficiency of the waterproofing system. The material which the central core is made of can be furthermore injected with sealing fluids so that it allows the creation of a new waterproofing barrier if needed, in localised areas or along the entire length and height of the central core.

The described solutions guarantee very long durability. The use of geomembranes for waterproofing of the central core guarantees high reliability since geomembranes of this type have been operating for a great number of years on the facing of conventional dams. Accelerated ageing tests, carried out in the laboratory, have hypothesised a duration of the waterproofing material exceeding 500 years. Furthermore, the geomembranes themselves, by being embedded in the central core, are protected from the action of the ultraviolet rays and from vandalism, and are therefore practically indestructible.

Waterproofing Layered Membrane on the Upstream Face

With reference to the FIGS. from 15 to 17, we will now describe a variant of the invention which allows the construction and waterproofing of embankment dams; including an exposed barrier on the upstream side, where a layered waterproofing membrane is laid and suitably anchored to the surface of the dam upstream face, so as to allow the layered membrane to follow and/or adapt to any settlement movements of the dam thus constructed.

Also in case of FIGS. 15–17, the dam body 211 is executed with a suitable loose material, earth and/or rock, suitably placed by layers 212.1–212.n, superimposed and compacted.

In this case on the surface of the upstream face a waterproofing liner is provided, comprising a waterproofing package 213, whose composition is similar to the composition of waterproofing packages 13, 131, 132 of the previous examples. Therefore the waterproofing package 213 consists of several adjoining bands or sheets 214, which extend in the direction of the slope of the upstream face, between the crest of the dam and the upstream foundation toe.

The single bands 214 of sheet material are unrolled and laid down on the upstream surface of the dam, and are fastened as they are placed to anchoring strips 215 in flexible synthetic material, suitably embedded between superimposed layers 212.1–212.n of the dam body.

The sheet material of the waterproofing package 213 is preferably a geocomposite including a layer of flexible and waterproofing synthetic material, coupled to a substrate of synthetic material having different properties. In particular the superficial layer, which will be in contact with the water impounded in the reservoir of the dam, and therefore exposed also to the atmosphere, consists of a flexible synthetic geomembrane, impermeable and elastically yielding, for example in PVC, PP, PE or similar, while the underlying layer which will be in contact with the surface of the dam, consists of a geotextile which performs the function of protective layer to avoid puncturing of the geomembrane, and at the same time supplies dimensional stability improving the friction coefficient of the composite geomembrane thus obtained.

Depending on the type of geotextile material adopted, and depending on the stony material and/or the characteristics of the material constituting the surface of the dam with which the geocomposite will be in contact, in general a natural friction angle is created, comprised between 25 and 38 degrees. This means that depending or the slope of the upstream face of the dam, always included between the above-mentioned degrees, or inferior, during the installation of the waterproofing membrane the sheets of material 214, before being welded to the anchoring strips 215, remain stable and therefore do not slide, facilitating the installation. The waterproofing package 213 can also be built so that the waterproofing geomembrane is independent from the geotextile which performs the function of protective layer. In this case the geotextile sheets are installed in contact with the upstream face of the dam, on which they are stable during installation, and the waterproofing geomembrane is placed over the geotextile and anchored to sheets 215.

As previously described, the single sheets of material 214 which compose the waterproofing package 213 must in any case be anchored to the dam body; should sheets 214 consist of a geocomposite (waterproofing geomembrane coupled to the geotextile), the underlying layer geotextile co-operates in granting their stability and their resistance to sliding, to resist the actions due to waves and to wind in the part uncovered by water, and their resistance to loads due to possible sediments or accidental loads which can affect the geomembrane, or to any underpressures which could be generated at the back side of package 213, in case of rapid dewatering of the reservoir.

The anchorage of the single sheets of material 214 which compose the waterproofing package 213 is made by means of strips 215. For this purpose, the anchoring strips 215 can be constituted with the same material which constitutes package 213, or with a synthetic material having similar chemical characteristics in order to allow welding by thermo-fusion.

In particular, as shown in the example of FIG. 16, and in the detail of FIG. 17, the anchoring strips 215 are laid between superimposed layers of the loose material constituting the dam body, during construction of the dam itself.

The anchoring strips 215 are placed parallel to the longitudinal axis of the dam and in such a way that the waterproofing synthetic material, which can be welded, faces the reservoir of the dam. The strips have a back side 215' which is placed on a substantially horizontal plan, firmly fastened between two superimposed layers 212' and 212" of the stony material constituting the dam body. The anchoring strips 215 extends outside of the dam body with a front wing 215" which by gravity lies downwards in an L shape, against the external surface of the upstream face, in correspondence of the lower layer 212'. In alternative, the same wing 215" can be folded upwards against the upper layer 212" after its construction.

As shown in FIG. 16, the anchoring strips 215 are placed at different elevations, on several lines, maintaining an alternate or staggered disposition between the anchoring strips of one line and the anchoring strips of the two contiguous lines, with interaxis or distances which can vary, and at different elevations, depending on each specific project.

The sheets of waterproofing material 214 rolled up in rolls are progressively laid starting from the crest, or from any intermediate elevation, towards the dam upstream toe, and during their unrolling they will progressively cover the anchoring strips 215 which have been embedded in the layers of loose material which form the dam body.

In correspondence of the overlapping of the sheets constituting package 21 with the wings 215" of the anchoring strips, part of the geotextile layer is removed or cut-out from each geocomposite sheet 214, creating a welding area 216, so that the back surface of the layer of synthetic material of the geomembrane, in the area 216 uncovered by the geotextile, is in contact with the front surface of wing 215", which is in a material chemically compatible, in order to allow the welding by thermo-fusion. In case the waterproofing geomembrane and the geotextile are independent, before the installation of sheets 214 it will be necessary to remove the section of geotextile in correspondence of strips 215, in order to create the welding area 216.

Welding can occur by points, by lines or on the whole surface of area 215" of the anchoring wing according to the requirements of each project.

As shown in FIG. 17, in a way similar to the previous examples, a transition and draining zone 217 is created between the waterproofing package 213 and the earthfill and/or rockfill, during the construction of the dam. Zone 217 consists of gravel and/or material with a suitable grading, permeable to water for the drainage of any leakage, and injectable by sealing fluids.

A second alternative for the fastening of the waterproofing membrane to the dam body is shown in FIGS. 18 and 19 of the drawings attached.

As shown, also in this case the dam body is formed by superimposed layers 312'–312", foreseeing during the construction of the dam the insertion of anchoring strips 315 to which the waterproofing membrane 313, perfectly identical or similar to the one of the previous examples, is then welded.

In case of FIGS. 18 and 19, unlike in the previous example where the anchoring strips 215 were folded in an L shape downwards or upwards against the upstream face of the dam, in this case during the construction of the dam body by superimposed layers, the anchoring strips 315 are "C" folded, so that each anchoring strip 315 has a first extreme part 315' embedded in the material of one layer, a second extreme part 315" embedded between the material of the previous layer and the material of the following layer, and an intermediate part 315" for welding the waterproofing membrane 313 which extends on the front surface of the dam body, between the two extreme parts 315' and 315" of the same anchoring strip.

Also in this case, if the waterproofing membrane 313 is a geocomposite, the back geotextile layer shall be removed, while if the geotextile is independent it shall be removed in correspondence with strips 315, in order to create in any case a welding area 316, also providing between membrane 313 and the earth and/or rock layers of the dam body, a transition and drainage zone 317 in loose material with a fine grading, as in the previous case.

In all cases, in order to obtain a higher protection degree for the membrane, a further protection layer consisting of a geotextile or similar can be optionally provided between the membrane and the transition and/or drainage zone 12, 122, 123, 212 and 312.

In the previous examples, as shown in FIG. 16, a disposition parallel to the slope of the dam upstream face has been hypothesised for the sheets of material 214 which constitute the waterproofing membrane; yet, it is evident that the installation of the membrane, instead of by bands parallel to the slope, can be executed by horizontal bands, as schematically shown in FIG. 20, starting in this case from the dam upstream toe and proceeding towards the crest, and partially overlapping the horizontal edges of contiguous bands; in this way it is possible to partially exploit the dam during its construction. In alternative to what previously described, the anchoring strips 215 or 315, instead of creating distanced anchoring points, could be prolonged for part or for the whole length of the dam, practically creating continuous welding areas. Both in case of installation of sheets 214 parallel to the slope, and of installation by horizontal bands, loss of watertightness that should occur in the membrane, in damaged areas, can be repaired by welding elements of synthetic materials identical or compatible with the material of the membrane itself.

The advantage of the solutions with geomembrane on the upstream face consists in the fact that a continuous waterproofing liner, installed on the surface of the upstream face, prevents water from infiltrate into the upstream part of the dam body.

Perimeter Anchorage

In all cases suitable anchoring devices of the waterproofing membrane shall be provided in correspondence of the upstream toe and of the crest of the dam.

At crest, the waterproofing membrane can be, for example, embedded in a trench where the edge of the membrane is laid down and suitably ballasted with gravel or other material, or can be anchored by a mechanical, anchorage whenever there is a concrete structure, for example a road curb, a parapet wall or other structure which normally constitutes the upper finishing of the dam.

The fastening of the membrane to the upstream toe of the dam and along the whole periphery, in case of FIGS. from 15 to 20 can be executed in any way which is adequate to grant a continuity of the waterproofing barrier towards the underlying ground, for example as shown in FIG. 15 and in the detail of FIG. 21.

In this case the execution of a concrete perimeter plinth 400 is foreseen, to which the lower edge of the waterproofing membrane 213 is watertight anchored, by folding it forward and against the upper surface of plinth 400, if necessary regularised by means or suitable resins, to which the edge of the membrane itself is fastened by means of a metal profile 401 which compresses membrane 213 against plinth 400 With the interposition of a gasket strip 402 and/or of a regularisation layer 405; profile 401 is anchored to plinth 400 by means of a plurality of threaded rods 403 partially embedded or secured in the concrete of the plinth, on which fastening nuts 404 are screwed. Another way of anchoring the membrane to plinth 400 can be an "insert" type anchorage: a slot is created in plinth 400 into which the membrane is inserted and then watertight anchored by embedment in proper waterproofing substances such as epoxy resins or similar.

The anchorage of the membrane to plinth 400 also allows to execute grouting of proper fluid substances for the creation of a waterproofing screen which prevents water from entering between plinth 400 and the contact surface with the foundation ground, in a way similar to the case of FIG. 3.

The anchorage to plinth 400 provides a soft connection of the membrane between the dam body and the base plinth, as illustrated in FIG. 21.

For this purpose, the lower edge of membrane 213 is folded to create a bend 220 along a trench 221 executed between the inside edge of plinth 400 and the transition zone 217.

The advantage of this solution is that in case settlements occur in the dam body, bend 220 allows the membrane 213 to deform following the movements of the dam body, creating an elongation compatible with the mechanical resistance of the membrane itself. If so required, it is also possible to create a layer of anti-grip material and provide a layer of protective geotextile along the trench for creation of the bend, between membrane 213 and zone 217.

Should the waterproofing membrane be ballasted with a covering element 222, as schematically shown in FIG. 21, trench 221 can be filled with a layer of loose material with a very fine grading, for example sand, which does not oppose a substantial resistance to the movement of membrane 213 in case it is subjected to tensile stress due to movement and/or settlements of the dam body. The filling layer will be a protection for membrane 213 from any mechanical action by ballast 222. If needed, it is also possible to create a layer of anti-grip material and provide a layer of protection geotextile, along the trench for creation of the bend, between membrane 213 and area 221.

The advantage of using a geocomposite consists in the fact that the geotextile substrate, if coupled adherent to the PVC waterproofing layer or other proper elastically deformable synthetic material, supplies an increase in the mechanical resistance of the geocomposite itself. Therefore, in the event that significant deformations are caused in the geocomposite, normally in the range of 10–20%, the geotextile substrate which is heat-welded to the PVC layer or similar layer, is detached from it, allowing the two layers to become independent. Therefore, due to the strong friction, the geotextile will remain adherent to the diaphragm consisting of the layer of transition material in the dam body, while the elastic PVC geomembrane or similar, having an elongation coefficient which is significantly higher and which can reach values as high as 300%, will be able to move freely on the underlying geotextile and to therefore contribute with a larger surface to the distribution of the stresses.

However, it is clear that what has been said and shown with reference to the attached drawings has been given as an exemplification and illustration of the general principles of the invention, and of some of its preferential configurations, and that it is intended that other modifications and alternatives are possible both to the structure of the dam, to the structure of the transition core and/or of the waterproofing membrane, and in the construction techniques, without departing from what as being claimed.

What is claimed is:

1. A method of waterproofing a dam during construction of the dam, where the dam has a longitudinal axis, an embankment body of superimposed layers of earth and/or rocks, a waterproofing geomembrane, and at least one transition zone of fine loose materials that develop from a bottom to a top of the embankment body and along the longitudinal axis of the dam, the method comprising the steps of:

disposing the transition zone on at least a downstream side of the geomembrane;

partially embedding and securing anchoring strips into at least one of the transition zone and the embankment body;

gradually extending the geomembrane on the transition zone during construction of the dam; and anchoring the geomembrane to the transition zone by heat-welding the geomembrane to the anchoring strips.

2. The method according to claim 1, further comprising the step of providing a supporting substrate of geotextile synthetic material, coupled to the waterproofing geomembrane on a side facing towards the transition zone.

3. The method according to claim 2, further comprising the step of providing an additional substrate of geotextile synthetic material between the supporting substrate and the body of the dam.

4. The method according to claim 1, further comprising the step of disposing the waterproofing geomembrane in correspondence of an upstream face of the body.

5. The method according to claim 4, further comprising the step of forming a freely deformable and bendable portion along a bottom edge of the geomembrane and fastening the portion with anchoring devices to a foundation of the dam.

6. The method according to claim 5, further comprising the step of protecting the portion with a back-layer of fine loose material.

7. The method according to claim 5, further comprising the step of providing a substrate of geotextile synthetic material to protect the waterproofing geomembrane with respect to a layer of ballasting material resting on the portion.

8. The method according to claim 4 in which the waterproofing geomembrane comprises a plurality of bands of sheet material, the method further comprising the step of constructing the waterproofing geomembrane by positioning the bands side-by-side and downwardly extending in a direction of a slope of an upstream face of the dam.

9. The method according to claim 4 in which the waterproofing geomembrane comprises a plurality of bands of sheet material, the method further comprising the step of constructing the waterproofing geomembrane by arranging the bands side-by-side, horizontally extending on an upstream face and in a direction of the longitudinal axis of the dam.

10. The method according to claim 9, wherein the waterproofing geomembrane is constructed starting from a foundation of the dam, to allow a partial exploitation of the dam during its construction.

11. The method according to claim 4, further comprising the step of welding pieces of synthetic material to repair a damaged part of the waterproofing geomembrane.

12. The method according to claim 1, wherein the step of anchoring the waterproofing geomembrane is accomplished with L-shaped strips of synthetic material having a portion embedded into the transition zone and the body and including an anchoring wing welded to the waterproofing geomembrane against an upstream face of the dam.

13. The method according to claim 12, further comprising the step of staggering the anchoring strips along horizontal lines parallelly arranged to the longitudinal axis.

14. The method according to claim 12, wherein the anchoring strips are continuous, and further comprising the step of providing the continuous anchoring strips along horizontal lines, parallel to the longitudinal axis, for a part or whole length of the dam.

15. The method according to claim 1, wherein the step of anchoring the waterproofing geomembrane is accomplished with C-shaped strips of synthetic material having end portions embedded into the transition zone and the body and including an intermediate anchoring portion welded to the waterproofing geomembrane against an upstream face of the dam.

16. The method according to claim 1, wherein the transition zone has a permeability and injectability between $1\times10^{-1}$ and $1\times10^{-5}$ cm/sec.

17. The method according to claim 1, wherein the waterproofing geomembrane is embedded into a core of fine loose material inside the body.

18. The method according to claim 1, further comprising the step of forming the geomembrane in a central position of the body by disposing two of the waterproofing geomembranes parallel and spaced apart in respect to the longitudinal axis, and providing a core of fine loose material in an intermediate zone between the two geomembranes.

19. A dam for impoundment of water, comprising:

an embankment body of superimposed layers of earth and/or rocks;

a waterproofing barrier comprising plural waterproofing bands of geomembrane material arranged side-by-side and having sealingly welded edges;

a transition zone on at least one side of the barrier and comprising superimposed layers of loose material having a water permeability between $1\times10^{-1}$ and $1\times10^{-5}$ cm/sec; and said barrier further comprising anchoring strips that are heat-welded to said geomembrane material and at least partially embedded in at least one of said transition zone and said body.

20. The dam according to claim 19, further comprising at least one protection layer of flexible synthetic material between each side of the waterproofing barrier and the transition zone.

21. The dam according to claim 19, wherein the geomembrane material comprises a layer of thermoplastic sheet material coupled to a supporting substrate of geotextile on at least one side thereof.

22. The dam according to claim 19, wherein the waterproofing barrier is watertight fastened to an anchoring beam provided parallel to a longitudinal axis of the dam and along a bottom perimeter of the body.

23. The dam according to claim 22, wherein the anchoring beam is parallelly arranged to an upstream toe of the body and wherein the waterproofing barrier extends under the body towards the anchoring beam.

24. The dam according to claim 19, further comprising a draining and monitoring pipe for water seeping through the waterproofing barrier.

25. The dam according to claim 19 having a rigid side structure, wherein the waterproofing barrier is watertight connected to the rigid structure by at least one freely deformable waterproofing strip.

26. The dam according to claim 25, wherein the waterproofing strip is shaped to form a set of bellows.

27. The dam according to claim 19, wherein the waterproofing barrier comprises first and second ones of the geomembrane material laterally spaced one from the other, and the transition zone comprises a central transition zone of fine loose material between the two geomembranes, and side transition zones of fine loose material on each side of the geomembranes which are opposite to the central transition zone.

28. The dam according to claim 27, wherein the two geomembranes extend parallel to a longitudinal axis of the dam.

29. The dam according to claim 28, wherein the geomembranes comprise plural longitudinal strips which are alternatively inclined in opposite directions on each side of the transition zone.

30. The dam according to claim 28, wherein the central transition zone between the two geomembranes is connected to a drainage and monitoring pipe for water seeping through the loose selected material of the central transition zone.

31. The dam according to claim 28, further comprising at least one transverse partition of waterproofing material between the two geomembranes.

32. The dam according to claim 28, wherein the loose material of the central transition zone between the two geomembranes has an injectability and waterproofing degree different from that of the loose material of the two side transition zones.

33. The dam according to claim 19, wherein the loose material of the transition zone is grouted with sealing substances in water seepage areas.

34. The dam according to claim 19, further comprising injection pipes for waterproofing substances.

35. The dam according to claim 19, wherein the anchoring strips are positioned along parallel rows on an upstream face of the body.

36. The dam according to claim 35, wherein the anchoring strips of each of the rows are staggered in respect to the anchoring strips of a contiguous one of the rows.

37. The dam according to claim 19, wherein at least a protection substrate of synthetic material is disposed between the waterproofing barrier and the transition zone.

38. The dam according to claim 19, wherein the waterproofing bands are parallel to a slope of an upstream face of the dam.

39. The dam according to claim 19, wherein the waterproofing bands are parallel to a longitudinal axis of the dam from a bottom of the dam.

40. The dam according to claim 19, wherein the geomembrane material is folded to create a freely extensible portion along its lower edge.

41. The dam according to claim 40, further comprising a loose ballasting material over the extensible portion of the geomembrane material.

42. The dam according to claim 41, further comprising a protection layer of synthetic material between the ballasting material and the extensible portion of the geomembrane material.

43. The dam according to claim 42, further comprising a layer of anti-grip material between the ballasting material and the protection layer.

44. The dam according to claim 19, wherein a lower edge of the geomembrane material is watertight and mechanically fastened to a base plinth along a bottom perimeter of the body.

45. The dam according to claim 19, wherein a lower edge of the geomembrane material is fastened by watertight insertion to a base plinth along a bottom perimeter of the body.

* * * * *

UNITED STATES PATENT AND TRADEMARK OFFICE

CERTIFICATE OF CORRECTION

PATENT NO. : 6,612,779 B1
DATED : September 2, 2003
INVENTOR(S) : Alberto Scuero It is certified that error appears in the above-identified patent and that said Letters Patent is hereby corrected as shown below:

Title page,
Item [73], Assignee, change the name of the assignee form "Capri Tech Italia S.r.l." to -- Carpi Tech Italia S.r.l. --.

Signed and Sealed this

Eleventh Day of November, 2003

JAMES E. ROGAN
*Director of the United States Patent and Trademark Office*